US007641528B2

(12) United States Patent
Stolper

(10) Patent No.: US 7,641,528 B2
(45) Date of Patent: Jan. 5, 2010

(54) ENCLOSED SHAFT SYSTEM FOR MARINE PROPULSION

(76) Inventor: Peter R. Stolper, 2779 SE. Monroe St., Stuart, FL (US) 34997

( * ) Notice: Subject to any disclaimer, the term of this patent is extended or adjusted under 35 U.S.C. 154(b) by 263 days.

(21) Appl. No.: 11/867,358

(22) Filed: Oct. 4, 2007

(65) Prior Publication Data

US 2008/0214068 A1 Sep. 4, 2008

Related U.S. Application Data

(60) Provisional application No. 60/828,379, filed on Oct. 5, 2006.

(51) Int. Cl.
*B63H 21/36* (2006.01)

(52) U.S. Cl. ..... 440/112

(58) Field of Classification Search ..... 440/83, 440/52, 112

See application file for complete search history.

(56) References Cited

U.S. PATENT DOCUMENTS 2,072,001 A * 2/1937 Guthans ..... 384/149
2,521,368 A 9/1950 Hingerty, Jr.
3,580,214 A 5/1971 Muller
3,863,737 A 2/1975 Kakihara
4,127,080 A 11/1978 Lakiza et al.
4,786,264 A 11/1988 Asanabe et al.
4,813,898 A * 3/1989 Nakase et al. ..... 440/111
4,875,430 A 10/1989 Sirois
5,310,372 A 5/1994 Tibbetts
5,370,400 A 12/1994 Newton et al.
5,419,724 A 5/1995 Wyland et al.
6,758,707 B2 7/2004 Creighton

* cited by examiner

*Primary Examiner*—Ed Swinehart
(74) *Attorney, Agent, or Firm*—McHale & Slavin, P.A.

(57) ABSTRACT

The system is an enclosed, oil filled, shaft and thrust bearing assembly which includes an oil pump to circulate the oil throughout the system. The thrust bearing assembly allows the thrust to be directed to the shafts mounting system rather than through the vessels main propulsion engines and isolators thereby reducing vibration and noise emissions. In addition the elimination of thrust loading transmitted directly to the propulsion engines reduces wear and tear on the engine mounts, isolators and engine support structures. The non rotating casing of the shaft assembly allows clean water to flow to the propeller which allows more delivered horsepower to be used by the propeller.

12 Claims, 9 Drawing Sheets

ENCLOSED SHAFT SYSTEM FOR MARINE PROPULSION

CROSS-REFERENCE TO RELATED APPLICATIONS

This application is based and claims the filing date of Provisional Patent Application No. 60/828,379 filed Oct. 5, 2006 the contents of which are incorporated herein by reference.

FIELD OF THE INVENTION

The invention relates generally to power boats, specifically to the delivery of power from the engine of a power boat to a propeller, and back to the boat itself to effect forward or reverse motion in water. More specifically, my invention relates to a reliable and economical form of self-contained, enclosed drive shaft and associated components, suitable for installation on small boats.

BACKGROUND OF THE INVENTION

The enclosed shaft system of the present invention provides in a unified structure, including a unique arrangement of bearings and an impeller-distributor to create continuous circulation of fluid lubricant among all bearing surfaces, wherein one or more journal bearings stabilize shaft movement and permit the flow of lubricant. The invention further includes appropriate seals to contain lubricant within the shaft enclosure and exclude seawater there from and an isolator designed to cooperate with the remaining components and to provide long life with stable characteristics.

A problem with current draft shaft propulsion systems is the protrusion of a rotating shaft through the hull of a marine vessel. The exposure of the shaft to the marine environment requires a large amount of maintenance in order to prevent marine growth from coating the shaft. Marine growth is one of the greatest deterrents to proper and efficient performance of a marine vessel. Marine growth is typically of the animal type, acorn barnacles and tubeworms being the most prevalent. The growth causes excessive turbulence along the shaft, thereby reducing the efficiency of the vessel and associated propeller. The rotation of the shaft further imparting turbulence onto the propeller resulting in vibrations that is difficult to eliminate. The cleaning of an exposed propeller shaft is difficult due to its shape and the need to perform most such cleaning while the vessel is in the water.

DESCRIPTION OF THE PRIOR ART

The present invention is directed to an enclosed, oil filled, self contained, shaft and thrust bearing assembly including an isolator mount which is the entry point of the shaft system into the hull of the vessel and transmits all of the thrust from the propeller to the vessel's hull structure.

As can be readily determined from Kutta-Joukowski theorem & calculation of The Magnus Effect, removing the rotational element from a marine shaft greatly reduces lift, drag and the horse power required to generate them. Enclosing the shaft in a stationary casing then can be calculated as straight forward drag based upon presented area of the appendage. This can be determined by viewing a standard NACA Foil or fin section which is the elliptical result of a cross section through a shaft at the angle of incidence (shaft angle) of the fluid stream. A chart of drag factors for standard NACA foil series is shown below:

NACA Foil Series drag co-efficients

| NACA Series | Drag Co-efficients (<2 Degrees of incidence) |
|---|---|
| 63 | 0.0052 |
| 64 | 0.0045 |
| 65 | 0.0042 |
| 66 | 0.0038 |

The total drag on a fin or foil comes from two major components, induced drag (drag generated by lift) and profile drag (drag created by the shape and size of the foil). These two major drag components can be thought of as "active" and "passive" drag. Then, within "passive" or profile drag, there are two further components, drag due to the cross-section being presented to the incident flow, and wetted surface area drag due to the friction drag of the surface of the foil.

The passive drag components are present in both the enclosed as well as conventional exposed shaft systems. It is worthy of note however that the Magnus effect is more detrimental to the performance and power losses created by a spinning exposed shaft in a conventional system due to the presence of both "active", "passive" and "vortex" drag, than can be calculated for a non-rotating enclosed system, which only exhibits "passive" drag elements.

For every action there exists an equal and opposite reaction, simply put, the generation of lift, friction, and drag requires an equal input of energy to overcome itself.

Similarly, each cutlass style bearing within the shaft system adds an additional 3% of lost energy, plus more losses associated with stuffing boxes and shaft seals averaging approximately 2%. Extrapolation of the formulae defining the Magnus effect in a series, shows an increase relative to left and velocity, therefore total shaft horse power losses can range from 6% to more than 10% after all the components are added together.

Kutta-Joukowski Lift Theorem for a Cylinder

"Lift per unit length of a cylinder acts perpendicular to the velocity (V) and is given by:

$$L=pVG(\text{Lbs/Ft})$$

Where:

P=Fluid Density (slugs/Cu Ft)

G=Vortex Strength (Sq Ft/sec) ($G=2.\Pi.b.V_r$)

V=Flow Velocity (Ft/sec)

$V_r$=rotational speed (Ft/sec) ($Vr=2.\Pi.b.s$)

b=radius of cylinder s=revolutions/sec pi=3.14159

Two early aerodynamicists determined the magnitude of the lift force, Kutta in Germany and Joukowski in Russia. The lift equation for a rotating cylinder bears their names. The equation states that the lift L per unit length along the cylinder is directly proportional to the velocity V of the flow, the density p of the flow, and the strength of the vortex G that is established by the rotation.

$$L=p*V*G$$

The equation gives lift-per-unit length because the flow is two-dimensional. (Obviously, the longer the cylinder, the great the lift) Determining the vortex strength G takes a little more math. The vortex strength equals the rotational speed V, times the circumference of the cylinder. If b is the radius of the cylinder.

$$G=2.0*b*pi*V_r$$

Where pi=3.14159. The rotational speed $V_r$ is equal to the circumference of the culinder times the spin s of the cylinder.

$$V_r=2.0*b*pi*s$$

U.S. Pat. No. 5,310,372, to Tibbetts, is directed to a through hull assembly for a marine drive which includes a housing comprised of a forward and rear section and a shaft mounted therein. The housing is sealed and extends through the hull and contains thrust bearings at one end and needle bearings at the opposite end as well as lubricant.

U.S. Pat. No. 2,521,368, to Hingerty, Jr., is directed to an improved power transmission assembly for marine propulsion apparatus which is interposed in driving and thrust absorbing relation between the engine drive shaft and the propeller shaft of a boat.

U.S. Pat. No. 6,758,707, to Creighton, is directed to providing a mounting support for use in an inboard drive marine propulsion system. The center support and rear strut include one or more bearing assemblies as well as a seal for both ends of a support housing for preventing water from entering the support housing.

U.S. Pat. No. 5,370,400, to Newton et al, is directed to a sealing system for affecting a seal around a rotatable cylindrical shaft at a location wherein the shaft extends through a boat hull.

U.S. Pat. No. 3,863,737, to Kakihara, is directed to a stern tube bearing assembly having means for flowing a lubricating fluid from the fore end of the assembly to a reservoir at the aft end thereof before returning along the inside of the bearing.

U.S. Pat. No. 4,875,430, to Sirois, is directed to a method of assembling a marine propulsion assembly and boat.

These prior art patents disclose various constructions for marine propulsion systems. It would be highly desirable to utilize the disclosed self-contained shaft system that is enclosed, oil filled, shaft and includes a thrust bearing assembly which includes an oil pump to circulate the oil throughout the system. The system would reduce vibration and noise, allow more delivered horsepower to be used by the propeller, reduce installation time and increase the time between recommended maintenance.

SUMMARY OF THE INVENTION

Disclosed is an enclosed, oil filled shaft and thrust bearing assembly in a marine vessel. The enclosure eliminates the exposure of a drive shaft to the environment. In a conventional marine vessel drive shaft installation, the drive shaft is exposed to the saltwater thereby requiring sacrificial zincs to prevent premature corrosion and paint to prevent marine growth. Degradation of the zinc, as well as the paint, together with various environmental pressures can result in vibrations. The thrust bearing assembly allows the thrust to be directed to the shafts mounting system rather than through the vessels main propulsion engines and isolators thereby reducing vibration and noise emissions. In addition the elimination of thrust loading transmitted directly to the propulsion engines reduces wear and tear on the engine mounts, isolators and engine support structures. The non rotating casing of the shaft assembly, eliminates the Magnus Effect as can be calculated by the Kutta Jukowski theorem, allows clean water to flow to the propeller which allows more delivered horsepower to be used by the propeller. Anti-fouling paint will also last longer on a surface that does not rotate at high speeds.

Thus, it is an object of this invention to provide an affordable, enclosed shaft for propulsion of small boats. More specifically, my invention is an enclosed shaft system intended to replace existing fixed shaft technology as a single piece bolt on system.

Accordingly, it is a primary objective of the instant invention to substantially shorten the time required to install and align a shaft and engine system.

It is a further objective of the instant invention to substantially increase the maintenance interval of a drive shaft system, in the order of hundreds of hours before recommended maintenance.

It is yet another objective of the instant invention to deliver more horsepower to the propeller by on average due to reductions in friction within the drive train.

It is a still further objective of the invention is to provide advantages conventionally found in large commercial ships that can be mass produced for small pleasure craft.

It is a further object to provide linear support along the total length of the shaft by providing journal bearings that are evenly spaced along the shaft to prevent torque generated distortion along the shaft (formation of helix).

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
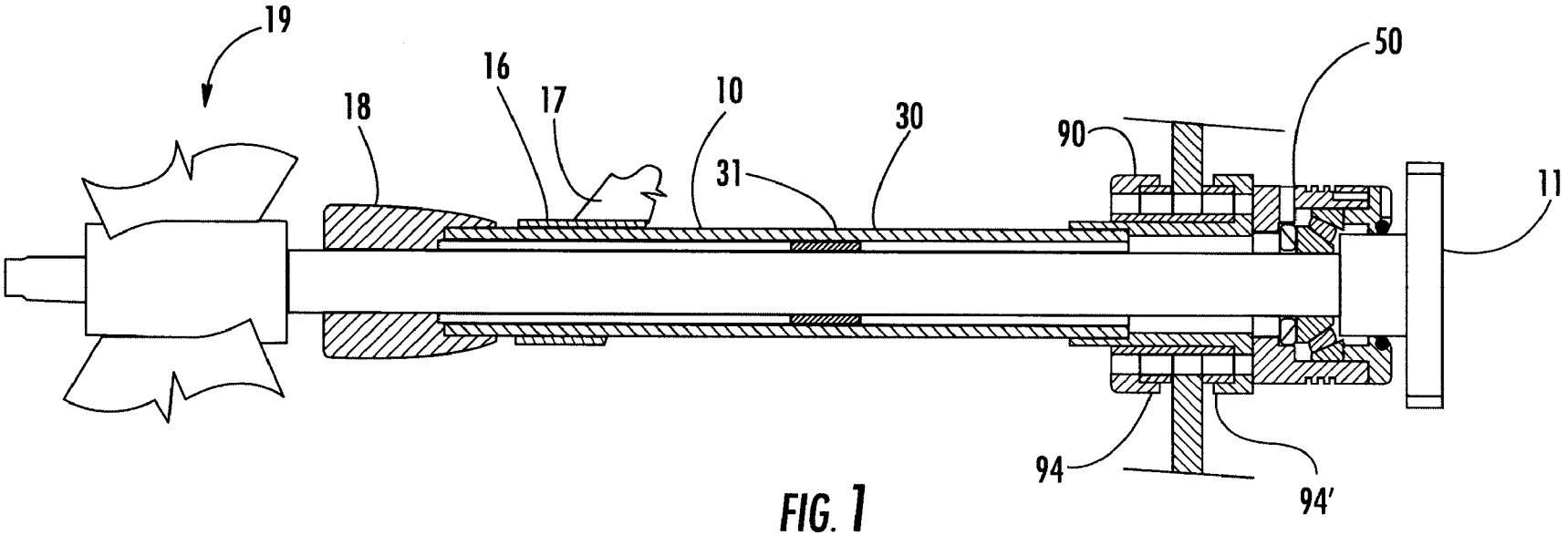
FIG. 1 is a breakaway side view of the enclosed shaft system showing its principal components and their relationship to external components: drive shaft, cylindrical enclosure, thrust assembly, isolator with hull section, journal bearing, aft bearing housing, and propeller hub.

Enclosed Shaft System. Referring first to FIG. 1, the outer casing or enclosure 30 of the enclosed shaft system is shown. In the preferred embodiment, it is constructed of stainless steel pipe of ASTM grade 316 or 304. The pipe size for each casing is carefully selected so that the mounting strut 17 used by the original equipment manufacturer (OEM) can, with little modifications; accommodate the casing once the original bearing (not shown) has been removed from the strut barrel 16.

Figure 3:
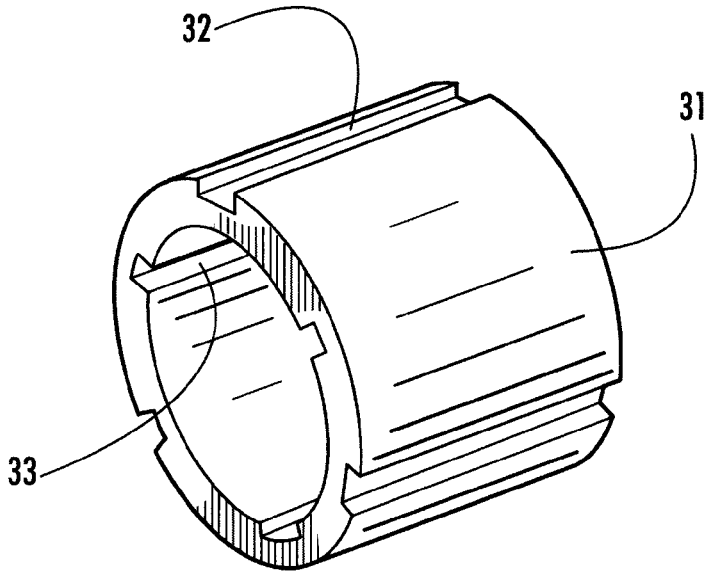
FIG. 3 is an isometric view of a journal bearing of the present invention showing inner and outer lubrication vents.

Journal Bearing or Bearings. Within the casing 30 there are one or more bronze journal bearings 31. These are fully hydrodynamic, i.e. they are fully submerged in fluid lubricant. The rotation of the shaft 10 pulls lubricant in the direction of rotation towards the center of the journal, and builds a dynamically generated pressure within the journal bearing 31, precluding metal-to-metal contact. In the preferred embodiment with proper tolerances, these bearings develop approximately 10 PSI at normal operating angular velocity. The principal purpose of the journal bearing 31 is to support the shaft 10 and reduce axial distortion under torsional loads, which can result in vibration and a reduction in the possible transmission of horsepower. A secondary benefit of the journal bearing 31 is to support the casing 30 against the shaft 10; the casing 30 is prone to deflection from dynamic pressure of the water flowing around it by motion of the vessel. As shown in FIG. 3, each journal bearing 31 includes external oil passageways 32 and internal oil passageways 33. External oil passageways 32 permit lubricant flow between the bearing 31 and casing 30 while internal passageways permit lubricant flow between the bearing 31 and the shaft 10.

A nominal 2-inch (5-cm) shaft 10 will carry the rigidity or longitudinal stiffness of a 3.5-inch (8.9-cm) shaft because of this additional support. I have found that a series of journal bearings 31 spaced between 20 and 30 inches (51 and 76 cm) apart is beneficial to the overall operating efficiency of the shaft system.

Figure 9:
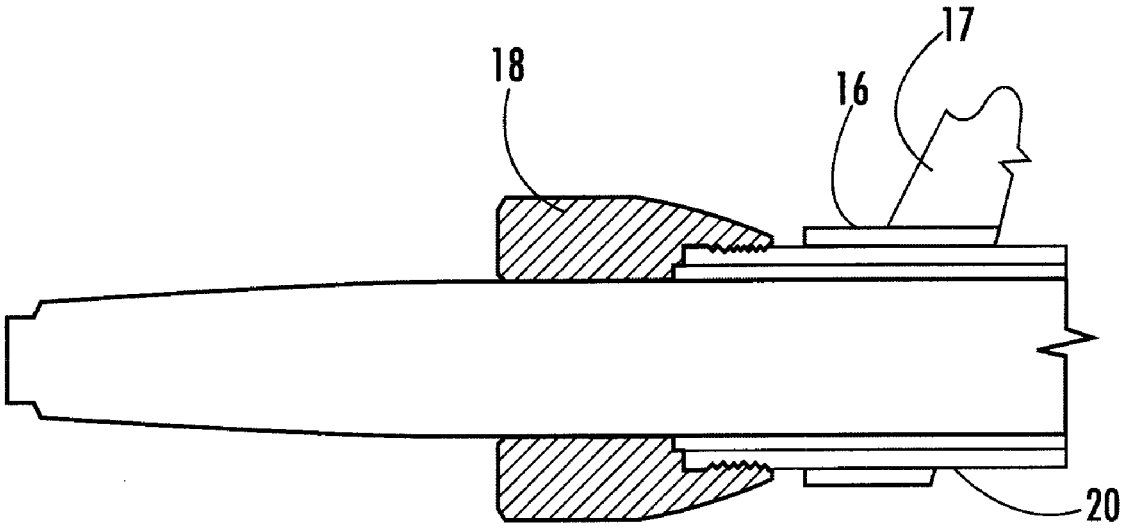
FIG. 9 is a side view of the propeller bearing housing, the shaft casing, and the vessels shaft mounting strut.

Casing with Isolator Mount. The casing 30 is threaded at both ends allowing one end to be threaded into the propeller bearing housing 18 and the other end to be threaded into the isolator mount 90. Apart from the threaded connections at the ends, the casing 30 carries no thrust from the propeller assembly 19 and is only a housing or conduit containing lubricant for the bearings; there is only minimal mechanical loading within the casing 30. Once the casing 30 is installed, the strut barrel 16 is injected with a marine grade structural polyurethane adhesive 20, such as 3M 5200 in the preferred embodiment, flexibly attaching the casing to the strut, reducing noise transmission and reducing metal to metal contact, as shown in FIG. 9.

Isolator Mount. Referring again to FIG. 1, the isolator 90 mount is developed to reduce the amount of space taken up by thrust assembly 50 within the engine room. This isolator 90 is mounted in place of the traditional stuffing box or dripless seals normally fitted to boats with shafts of the conventional art. It is the entry by the shaft system into the hull of the vessel, and transmits all the thrust from the propeller via the thrust bearings to the vessel's hull structure. It also seals the penetration point into the hull using two urethane bushing rings 94 and 94', one inside the hull and one outside.

Figure 5:
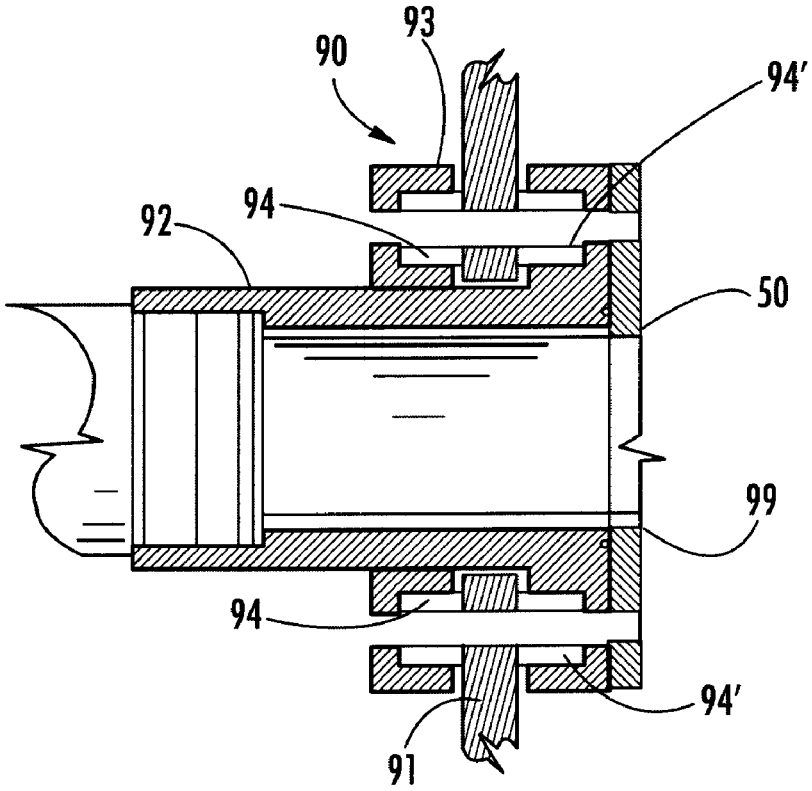
FIG. 5 is a sectional side detail of the isolator showing its penetration of the boat's hull or transom, and its sealing and supporting members.

Referring to FIG. 5, The isolator 90 mount is of a split design, an inner main isolator mount 92 and an outer isolator backing ring 93, together compressing urethane bushings 94 and 94' on both sides of the hull structure 91, sealing the point of entry of the shaft system, as well as providing a flexible mounting point to reduce transmission of noise and vibration.

The urethane bushings 94 and 94' are sized and are of the correct hardness that once compressed to the force that each model of shaft requires; they will transmit thrust to the hull structure 91 and flex sufficiently to provide a continuous water seal to the hull 91. Urethane has proved to be the preferred material in my invention due to its physical characteristics—it is impervious to most chemicals, retains tremendous dimensional stability (i.e., has no shape memory), retains stability at temperatures from −40 to +200° F. (−40 to 93° C.). The thrust assembly 50 is bolted directly to the isolator mount 90 thereby reducing the amount of space required within the hull relative to the conventional art. An O-ring seal 99 seals thrust assembly 50 to the isolator mount 90. The isolator mount 90 eliminates installation time for separate isolator and thrust assemblies, and further reduces total shaft installation time for a substantial saving to the boat manufacturer in overhead.

Figure 4:
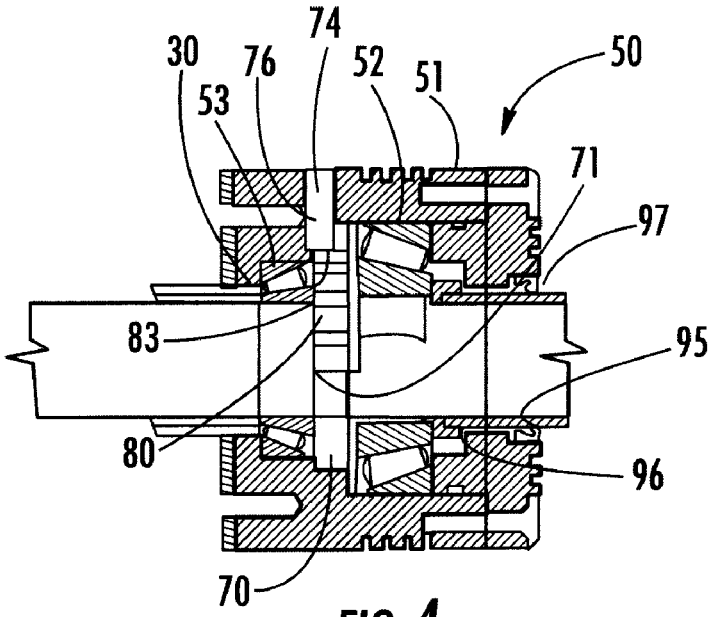
FIG. 4 is a sectional side detail of the thrust assembly, showing its principal components: forward and reverse tapered thrust bearings, impeller-distributor, and its housing.

Thrust Assembly. Referring to FIG. 4, there is shown the preferred thrust assembly 50 of the invention. The thrust housing 51 is preferably manufactured from 6061-T6 aluminum, carbon steel, stainless steel or bronze depending on application. This housing 51 contains components which together give the thrust assembly its unique efficiency. The thrust housing 51 is bolted to the main isolator mount 90 and transmits the thrust from the propeller 19 through the isolator mount 90 to the vessel hull structure 91. The following is a description of each of the components found within the thrust assembly 50 on a preferred embodiment of the invention.

Figure 4A:
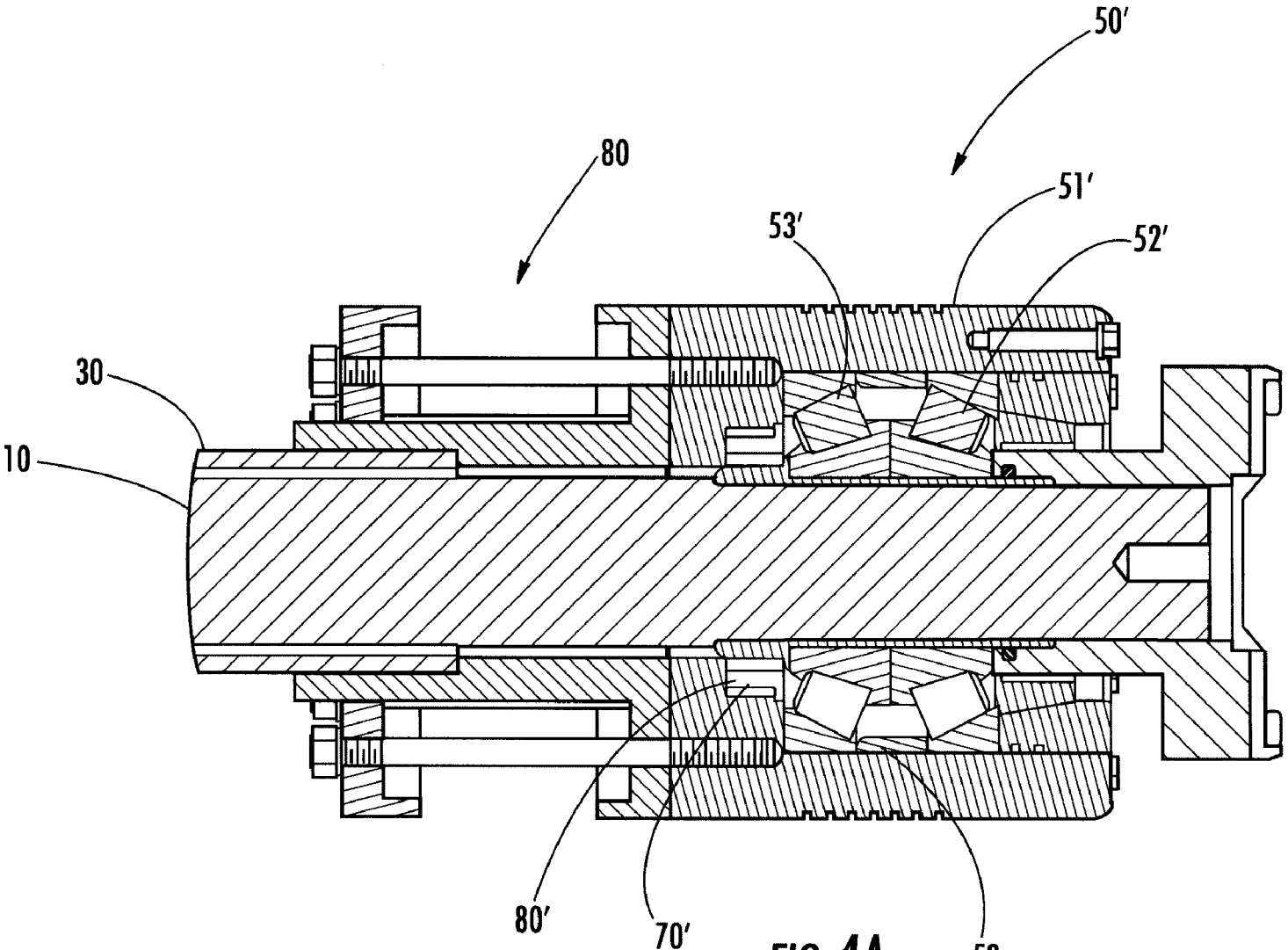
FIG. 4A is a sectional side view of an alternate embodiment of the thrust assembly described in FIG. 4.

Forward thrust bearing 52 and reverse thrust bearing 53 are tapered roller bearings manufactured for their thrust bearing properties and their ability to circulate lubricant in a predictable fashion. The forward and reverse thrust bearings are of the known art and are not, in and of themselves, regarded as separate inventive matter in the context of my invention. In the preferred embodiment, Timken taper roller bearings are selected. Oil Impeller/Forward Thrust Bearing Sleeve. Referring again to FIG. 4, between the forward thrust bearing 52 and reverse thrust bearing 53 is an impeller-distributor structure 70 which circulates fluid lubricant from thrust bearing housing 51 down the shaft casing and return it to a separate oil reservoir, and back to the bearing housing 51. An internally mounted lubricant impeller-distributor 70 integral to the thrust assembly 50 is regarded as a novel feature of the present invention. FIG. 4A shows an alternate embodiment of the thrust assembly 50' to thrust assembly 50 shown in FIG. 4. In this embodiment forward thrust bearing 52' is equal in size to reverse thrust bearing 53'. In addition, impeller—distributor structure 70' is located adjacent the reverse thrust bearing 53' on a side opposite from the forward thrust bearing 52' and not between the forward and reverse thrust bearings as shown in FIG. 4. Located between the forward and reverse thrust bearings 52' and 53' is an annular ring 58 which acts as a shim to provide the proper amount of running clearance within the taper bearings.

Figure 2:
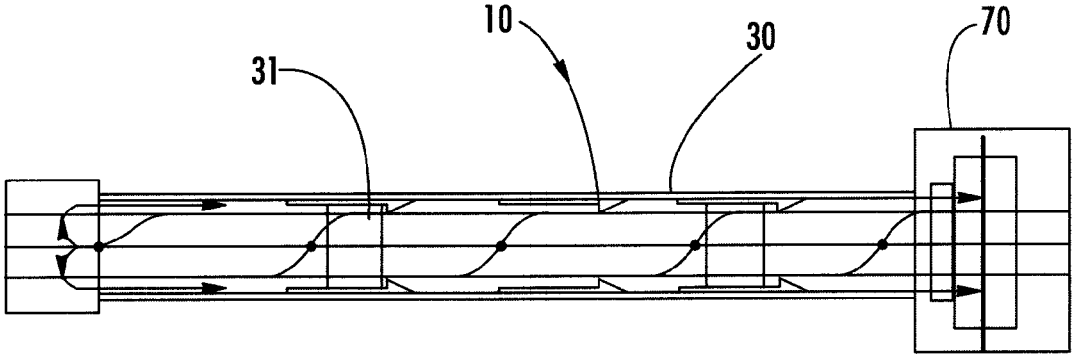
FIG. 2 is a schematic view of the enclosed shaft system showing flow of lubricant to and from a thrust assembly.
Figure 6:
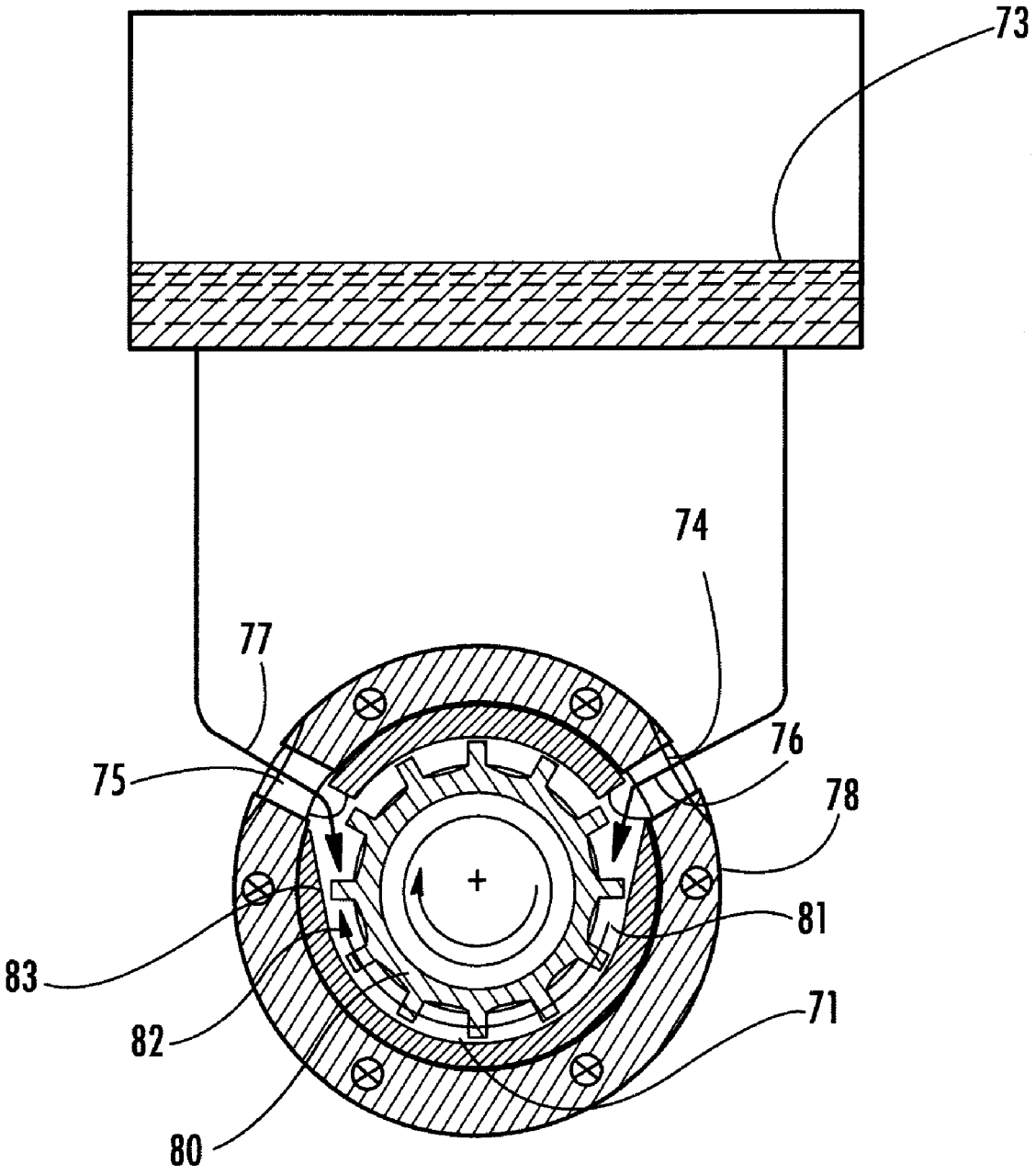
FIG. 6 is a schematic view of the impeller-distributor and its attendant oil reservoir, showing flow of lubricant from the reservoir through the impeller-distributor and back to the reservoir, and an end view of the impeller showing its principal components: inlet port, outlet port, barrier, inner lubricating port, outer lubricating port, and rotor.
Figure 7:
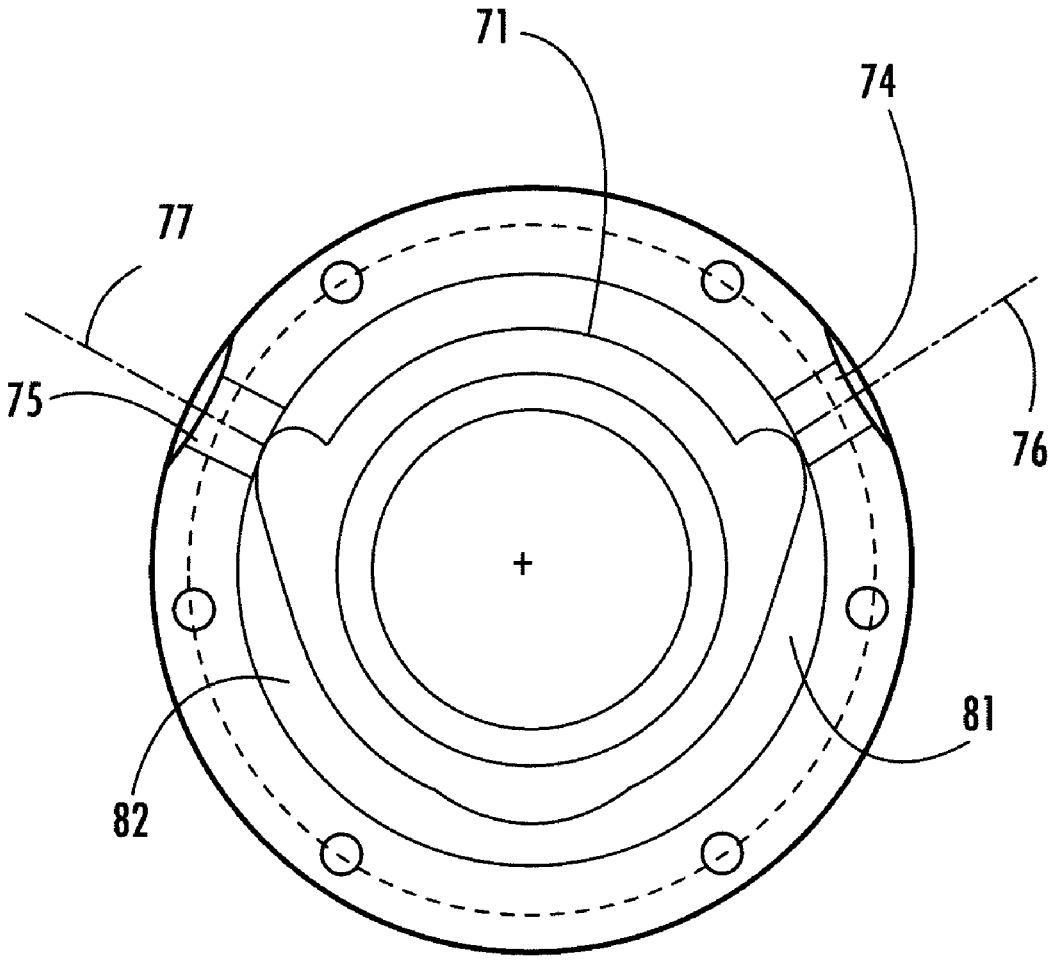
FIG. 7 is an end view of the impeller housing, or stator.
Figure 8A:
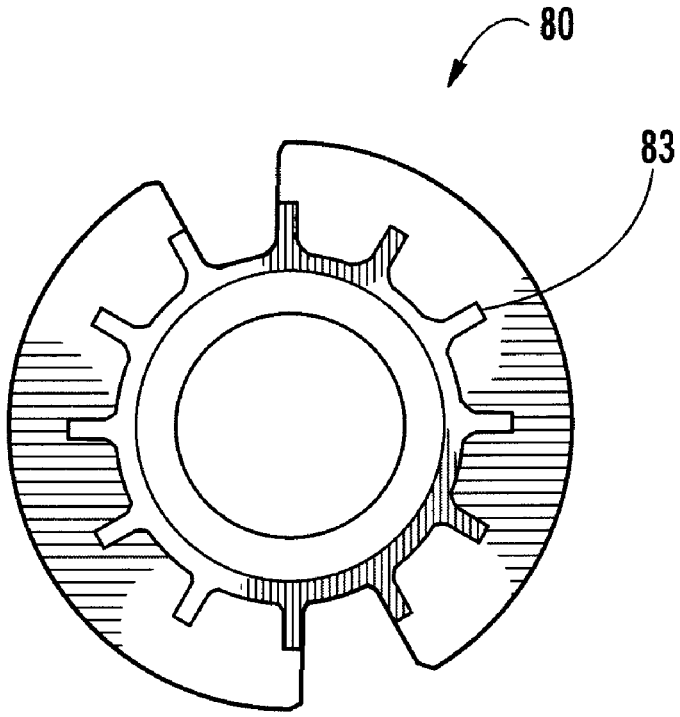
FIG. 8*a* is an end view of the impeller rotor.
Figure 8B:
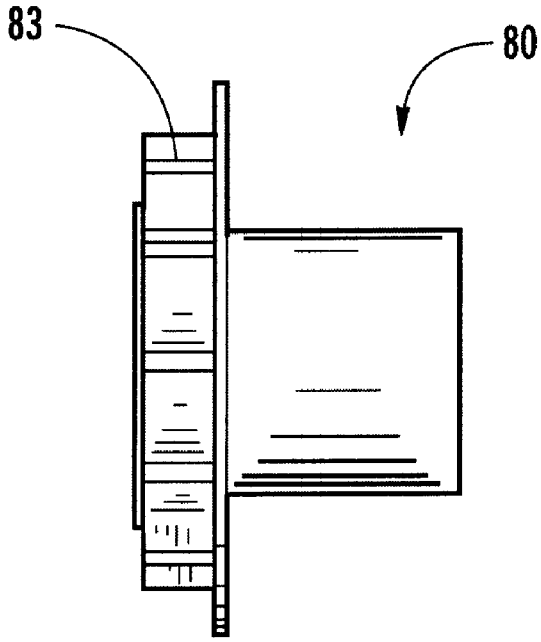
FIG. 8*b* is a side view of the impeller rotor.

Impeller-distributor. The impeller-distributor 70 has a centrifugal component of its pumping action, aided by the natural tendency of a taper bearing to displace oil in the direction of the narrow end of the taper. This centrifugal action of a taper bearing is known art, and described by manufacturer literature including *Timken Super Precision Bearings*, a catalog of bearings and application notes. Referring now to FIG. 6, a shield or flange (impeller rotor 80) is a part of the design of the impeller-distributor of my invention, which mates closely with a shouldered impeller chamber of stator or impeller housing 71 and oil passages 81 and 82 machined into the main bearing housing 51, or stator 71. Lubricant displaced by taper bearings 52 and 53 is channeled and fed through radial slots 81 and 82 machined in the impeller stator 71 of the impeller-distributor 70, which then directs oil into the machined eccentric oil chamber within the thrust bearing housing. This coupled with the vanes 83 arrayed around the perimeter of the impeller rotor 80 and closely matched to the impeller chamber of stator 71, develops pressure within the leading oil passage 81 and suction within the trailing passage 82, inducing circulation to and from the lubricant reservoir 73. The lubricant is induced back from the reservoir 73 to the intake passage 81 via line 76 and port 74 of the impeller chamber of stator 71 by the impeller rotor 80 and pressurized within the impeller chamber 71. The lubricant is returned to the reservoir 73 via trailing oil passage 82 via line 77 and port 75. When the shaft, and hence impeller 80 rotation, is reversed, the flow to and from the reservoir is likewise reversed. Referring to both FIG. 6 and FIG. 2, the pressurized lubricant leaves the impeller 70 and is biased down the shaft casing 30 to the propeller bearing housing 18 past the tapered thrust bearing 52 or 53 and the uniquely shaped impeller chamber of stator 71 surrounding the impeller rotor 80. The rotating shaft 10 naturally pulls lubricant around itself in a helix close to the shaft, similar to the Magnus effect in freely rotating bodies. Lubricant at the propeller bearing housing 18 is turned around and forced to return against the natural flow of lubricant pulled down by the shaft 10; however, this lubricant returns against the inside surface of the outer shaft casing 30, returning to the main bearing housing 51, passing through the taper bearing 52 or 53 and then recycles back to the reservoir 73. The normal installed angle of a marine shaft, with inboard end slightly elevated, ensures that any air within the system ultimately will find its way to the reservoir, thereby bleeding the system. The impeller-distributor 70 is a passive unit in the sense that it is part of the rotating mass of the shaft, and has no metal-to-metal contact with non-rotating components (i.e., it is not gear driven) and therefore absorbs little or no power transmitted through the shaft system. The impeller stator 71 also is the main component supporting the forward thrust bearing 52 and is a main component of the thrust assembly 50. The forward taper thrust bearing 52 is installed against or on the sleeve end (depending on application) of the impeller and is fitted by compression to the impeller chamber 71 and to the reverse bearing 53, by pressure exerted by the companion flange or coupling 11. Bearing backlash, or the amount of running clearance within the taper bearing, is regulated by tolerancing the impeller distributor 70 by use of shims as or if required. This simplifies replacement of bearings 52 and 53 in the field as the manufactured tolerance of the bearings is close enough that backlash set at the factory is in all cases within the backlash tolerance preferred for my invention.

Seal Sleeve. Continuing to refer to FIG. 4, a seal sleeve 95 is used to compress the bearing pack referred to above, within the main thrust bearing housing 51 against the shoulder of shaft 10. A secondary function of the seal sleeve 95 is to form a lubricant seal between the shaft 10 and main thrust bearing housing 51. The faceplate of the thrust housing 51 carries a conventional rubber lip seal 97, the sealing surfaces of which ride on the surface of the seal sleeve 95. Inside the seal sleeve 95 is an "O" ring 96, which seals the seal sleeve 95 to the shaft 10. The companion flange or coupling 11 may be retained by a single stake nut of the conventional art and tightened to a torque setting appropriate for shaft size; it bears against the end of the seal sleeve 95, compressing the whole bearing pack.

Coupling. The coupling or companion flange 11 may be keyed or splined to the shaft 10, depending on specific application. The end of shaft 10 is threaded and a stake nut is appropriately torqued against the coupling 11, and staked to a machined keyway on the threaded shaft 10 to prevent loosening.

Integrated coupling and seal sleeve. In the preferred embodiment, the seal sleeve 95 and companion flange 11 may be of one piece, and may be mounted to the shaft by a drilled and tapped hole in the coupling end of shaft 10.

Figure 10:
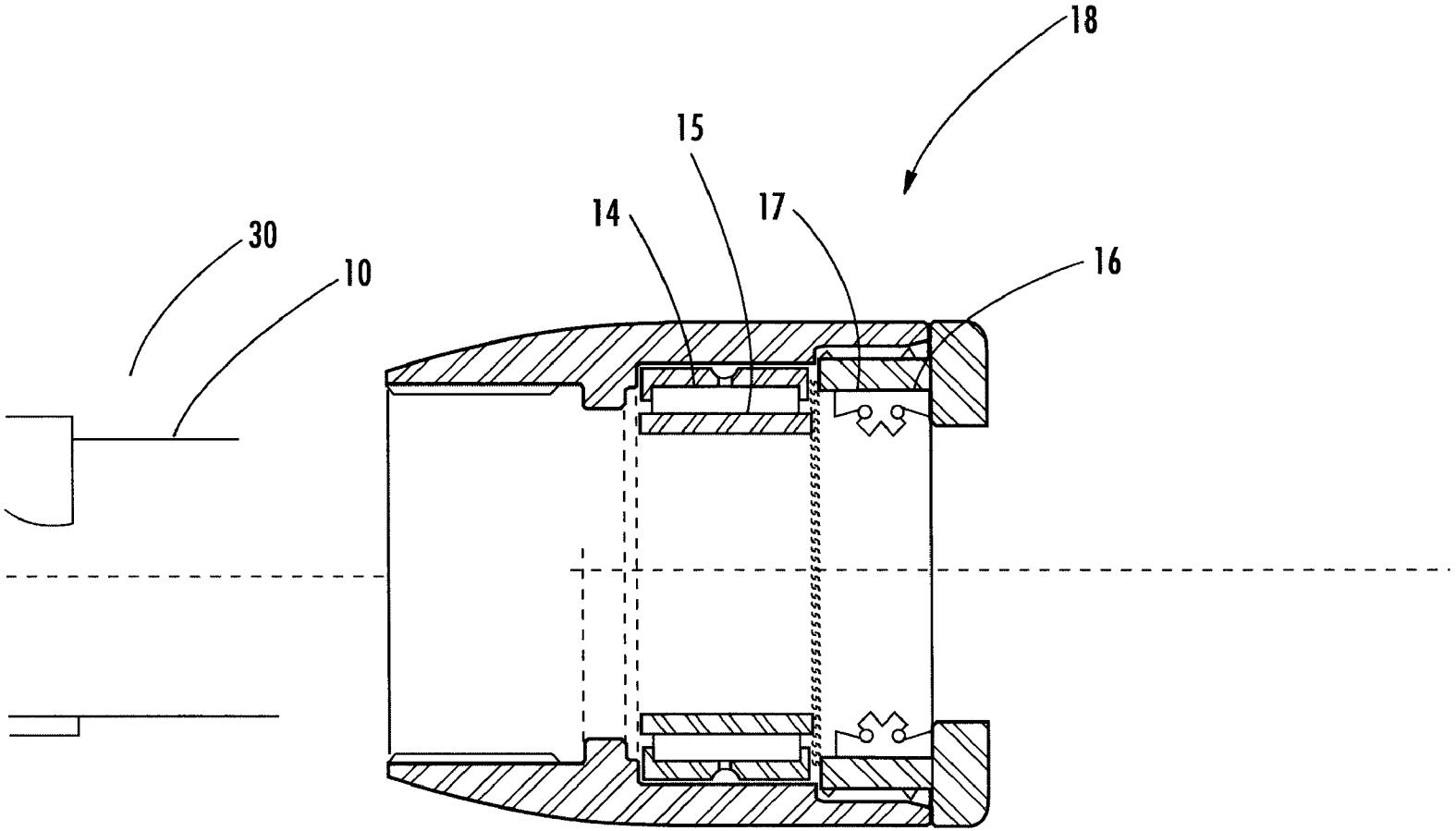
FIG. 10 is a cross sectional view of the propeller bearing housing including the shaft and shaft housing.

Propeller Bearing Housing. Referring again to FIGS. 1, 9 and in greater detail FIG. 10, a propeller bearing housing 18 is threaded onto the end of the casing 30 and consists of two housing components, both made of bronze to withstand salt water corrosion: the housing itself, and the seal carrier. The housing supports a heavy-duty needle bearing 14 which runs on a hardened inner ring race 15 installed to the shaft 10. This assembly carries only radial loads and is designed to withstand any impacts that may be encountered when the boater makes inadvertent contact with undersea obstacles. Terminating propeller bearing housing 18 is a seal carrier with two rubber lip seals 16 and 17 one facing outwards to stop water entering the system and one facing inwards to stop oil from escaping. The carrier is threaded or attached by any suitable means and is sealed to the housing. This seal carrier construction is regarded as of the conventional art.

Shaft. Drive shaft 10 is preferably made of high chromium stainless steel or better, noted for its high torsional strength and resistance to salt water corrosion. At the propeller end, drive shaft 10 is machined to conventional specifications with standard SAE or ISO taper and keyway or splines, and threaded to accept propeller retaining nuts and a cotter pin. At the inboard end, drive shaft 10 is machined with a shoulder to accommodate the thrust housing 51 and coupling component 11 to the inventor's own specifications, and threaded to accept a stake nut of the conventional art. A drive shaft 10 is preferably sized to accept the desired horsepower by applying a safety factor, generally a factor of 5.0 for Diesel engines and a factor of 2.0 for gasoline engines. Due to the extra support provided to the shaft system along its length by the casing 30 and attendant support bearings 31 (as shown in FIG. 1), a shaft 10 may be undersized with reasonable safety to deliver the same horsepower to the propeller. Safety factors of approximately 3.0 are satisfactory for medium to low Diesel horsepower applications and 4.0 for higher horsepower. This permits considerably lower system costs through material cost reductions, and achieves competitive equipment pricing and lower installation costs to the manufacturers along with eliminating warranty and maintenance issues. The system as disclosed has a first recommended maintenance schedule of 3,000 hours, a remarkable departure from the conventional art.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An enclosed shaft system to be incorporated into a marine propulsion apparatus of a vessel comprising: a shaft; said shaft having a first end that is adapted to receive a propeller and a second end that is adapted to be connected to a coupling for connection to an engine; an outer casing having a first and second end, said shaft extending through said outer casing; the first end of said outer casing being connected to a bearing housing, said bearing housing containing a bearing assembly for supporting said shaft, said shaft extending through said bearing housing, and a first seal assembly located between the shaft and the bearing housing; an isolator mount connected to the second end of the outer casing, said isolator mount adapted to pass through the hull of a vessel, said isolator mount including a sealing assembly between the isolator mount and the hull of the vessel, said shaft extending through the isolator mount; a thrust assembly containing forward and reverse thrust bearings supporting said shaft, said thrust assembly connected to the isolator mount, said shaft extending through said thrust assembly and a second seal assembly located between said thrust assembly and said shaft; whereby the thrust generated by the shaft is transmitted from the thrust assembly to the isolator mount, and, a source of pressurized lubricant that is circulated through said thrust assembly, said isolator mount, said outer casing and said bearing housing to thereby lubricate said enclosed shaft system.

2. An enclosed shaft system of claim 1, wherein the bearing assembly contained within the bearing housing is a needle bearing assembly which runs on a hardened ring race installed on the shaft.

3. An enclosed shaft system of claim 1, wherein the outer casing includes one or more journal bearings positioned within the outer casing and supporting the shaft.

4. An enclosed shaft system of claim 3, wherein each journal bearing is formed as a cylinder, the outer wall of said journal bearing in contact with the inner wall of said outer casing and the inner wall of said journal bearing in contact with said shaft, said journal bearing further including a plurality of external oil passageways formed on the outer wall of the cylinder and a plurality of internal oil passageways formed on the inner wall of the cylinder.

5. An enclosed shaft system of claim 1, wherein the isolator mount includes a main isolator mount adapted to be installed from within the vessel's hull, a first and second ring bushing, the first ring busing adapted to be mounted from within the boat and the second ring bushing being adapted to be mounted outside the vessel's hull, and a backing ring mounted outside the vessel's hull, and a plurality of bolts connecting the backing ring, the first and second bushing rings, the main isolator and said thrust assembly.

6. An enclosed shaft system of claim 1, wherein the thrust assembly includes an impeller positioned on and driven by the shaft to circulate lubricant throughout the enclosed shaft system.

7. An enclosed shaft system of claim 6, wherein the impeller is positioned on the shaft between the forward thrust bearing assembly and the reverse thrust bearing assembly.

8. An enclosed shaft system of claim 6, wherein an annular ring is positioned between the forward and the reverse thrust bearings to act as a shim and provide the proper amount of running clearance within the bearings.

9. An enclosed shaft system of claim 8, wherein the impeller is positioned on said shaft adjacent the reverse thrust bearing.

10. An enclosed shaft system of claim 1, wherein the outer casing is configured to be received in a barrel of a mounting strut attached to the hull of a vessel.

11. An enclosed shaft system of claim 10, wherein adhesive is injected between the outer casing and the barrel of said mounting strut to flexibly attach the outer casing to the strut thereby reducing noise transmission and metal to metal contact.

12. An enclosed shaft system of claim 1, wherein said first seal assembly is comprised of two rubber lip seals one of which faces outwards of the bearing housing to stop water from entering the enclosed shaft system and one facing inwards towards the outer casing to stop said lubricant from escaping.

* * * * *